US005281027A

United States Patent [19]

Thrall

[11] Patent Number: 5,281,027

[45] Date of Patent: Jan. 25, 1994

[54] MULTIPLE PLY BAG WITH DETACHABLE INNER SEAL POUCH FOR PACKAGING PRODUCTS

[75] Inventor: Ronald G. Thrall, Vancouver, Wash.

[73] Assignee: Bemis Company, Inc., Minneapolis, Mich.

[21] Appl. No.: 67,577

[22] Filed: May 26, 1993

Related U.S. Application Data

[63] Continuation-in-part of Ser. No. 837,558, Feb. 18, 1992, abandoned, which is a continuation of Ser. No. 534,968, Jun. 6, 1990, abandoned.

[51] Int. Cl.[5] ..... B65D 30/08

[52] U.S. Cl. ..... 383/88; 383/94; 383/109; 383/111; 383/113

[58] Field of Search ..... 383/85, 88, 94, 109, 383/111, 113, 123

[56] References Cited

U.S. PATENT DOCUMENTS

| | | | |
|---|---|---|---|
| 2,975,955 | 3/1961 | McCurry | 383/85 |
| 3,807,626 | 4/1974 | Goodrich | 383/111 |
| 3,910,488 | 10/1975 | Goodrich | 383/111 |
| 3,927,825 | 12/1975 | Stearly | 383/113 X |
| 3,929,275 | 12/1975 | Bolling et al. | 383/113 |
| 3,958,749 | 5/1976 | Goodrich | 383/111 |
| 4,065,049 | 12/1977 | Achelpohl et al. | 383/109 |
| 4,088,264 | 5/1978 | Vogt | 383/111 |
| 4,498,192 | 2/1985 | Becker et al. | 383/123 X |

FOREIGN PATENT DOCUMENTS

| | | | |
|---|---|---|---|
| 1021283 | 3/1966 | United Kingdom | 383/113 |

*Primary Examiner*—Allan N. Shoap
*Assistant Examiner*—Jes F. Pascua
*Attorney, Agent, or Firm*—Lee, Mann, Smith, McWilliams Sweeney & Ohlson

[57] ABSTRACT

A tubular bag blank has a plurality of outer contiguous non-heat sealable plies and an inner heat sealable plastic ply. All of the plies in the tubular blank are bonded together circumferentially around an open top end of the bag and are closed at the bottom end where only the non-heat sealable plies are bonded together. The inner heat sealable ply is freely folded and fully detachable in a non-adhesive manner at the bottom end of the bag. The inner plastic ply being heat sealable to closure at both bag ends. Upon heat sealing the bottom end, a plastic pouch is formed by the inner ply which may be heat sealed to closure at the open end when filled with a product or commodity and may be optionally severed thereat by compressive heat and pressure applied to the outer non-heat sealable plies. When fully packed, the outer paper plies may be stripped away leaving a sealed plastic pouch with the packaged contents therein ready for use by the purchaser.

15 Claims, 6 Drawing Sheets

MULTIPLE PLY BAG WITH DETACHABLE INNER SEAL POUCH FOR PACKAGING PRODUCTS

BACKGROUND AND SUMMARY OF THE INVENTION

This is a continuation-in-part of U.S. application Ser. No. 07/837,558, filed Feb. 18, 1992, now abandoned which is a continuation of U.S. application Ser. No. 07/534,968, filed Jun. 6, 1990, now abandoned.

The invention pertains to a bag for the packaging of products or commodities of the type having a sealed inner pouch within a multiple ply enclosing bag, and methods for making the bag, and for filling and sealing the bag.

More particularly, the invention is directed toward an improvement in a multiwall bag of the type formed from a tubular flat blank.

The invention is also directed to the type of product package that includes a standard pinch bottom for the outer multiple plies at the bottom end of the bag. In this type of bag the commodity-holding pouch is formed from an inner plastic ply that is heat sealed at the pinch closure of the outer enclosing bag and open at the opposite end for receipt of a product to be packaged. Upon filling the bag to a desired amount, the inner plastic ply is heat sealed to close the open end and thereby create a sealed pouch which may remain detachably bonded to the top end of the outer plies or optionally might be severed to separate the plastic pouch from the top end of the outer plies. In this regard the invention is further directed toward those product bags wherein the multiple outer plies are subsequently folded and bonded together at the top cut following the heat sealing of the plastic ply.

The invention further provides for an improvement in multiwall type bags as described, which utilize an adhesive bonding, or equivalent, of the inner plastic ply to the innermost ply of the outer plies, wherein the outer plies comprise a plurality of contiguous overlying non-heat sealable plies bonded together.

The present invention is an improvement in the packaging arts which have heretofore evolved, such as that disclosed in U.S. Pat. No. 4,088,264, entitled "Multiwall Pouch Bags for Detached Packaging of Commodities", issued May 9, 1978 to Vogt. In this patent, open ended, pinch bottom, multiwall bags are disclosed as having an inner ply of heat sealable plastic material, such as polyethylene, and one or more outer plies of a non-heat sealable material, such as paper or equivalent. The plastic ply is bonded at both bag ends to the contiguous outer plies during bag manufacturing and heat sealed and severed at the lower heat sealed zone during the bag bottoming operation. At the top opening of the bag, following the introduction of a product, commodity, or items, the plastic ply is heat sealed to closure and must be severed along the upper heat seal zone prior to closure of the outer plies. The result is a fully closed plastic bag inside of the fully closed paper bag. The problems that exist with this design are that when the unfilled bag is standing ready to be filled, the inner plastic bag is shorter in length than the enclosing outer paper bag. As the commodity is discharged or placed into the bag during the filling process there often are uneven and excessive pressures exerted on the lower plastic seal creating a potential for seal failure or pinholing along the bottom heat seal zone. Also, a slight collapsing of the outer bag can be caused as the weight from the commodity forces the upper portion of the bag downward, thus creating problems with the integrity of the upper closure.

The present invention greatly reduces the possibility of bottom plastic seal failure, or bag collapse during the bag filling process, and offers significant improvement over previously known techniques and bag constructions.

BRIEF SUMMARY OF THE INVENTION

The invention solves the foregoing problems in multiwall bag constructions and methods of making them by providing an inner plastic bag that is as long as the outer paper bag during the filling process. The bottom plastic seal is folded (wrapped) around the pinch bottom fold line at the bag bottom during the bag bottoming operation, but is not adhered or bonded to the contiguous outer plies. Instead, it is loosely, or freely folded with the outer contiguous plies which provides for partial restraint thereat during filling by virtue of staying in place at the bottom pinch closure. Therefore, the lower plastic heat seal is protected from excessive pressures during the bag filling process. Likewise, because the inner plastic pouch is as long as the outer paper bag, the probability of collapsing the upper portion of the bag during the bag filling process has been reduced, giving greater insurance of a proper closure of the open top bag end once the product or commodity has been introduced.

BRIEF DESCRIPTION OF THE DRAWINGS

The invention will be further described in detail with reference to the accompanying drawings wherein like reference numerals throughout refer to the same elements and wherein:

FIG. 1 is a perspective, partially broken away, view of the multiply bag in accordance with the invention ready to be filled by the packer with a commodity or the like;

DETAILED DESCRIPTION OF THE INVENTION

Figure 1:
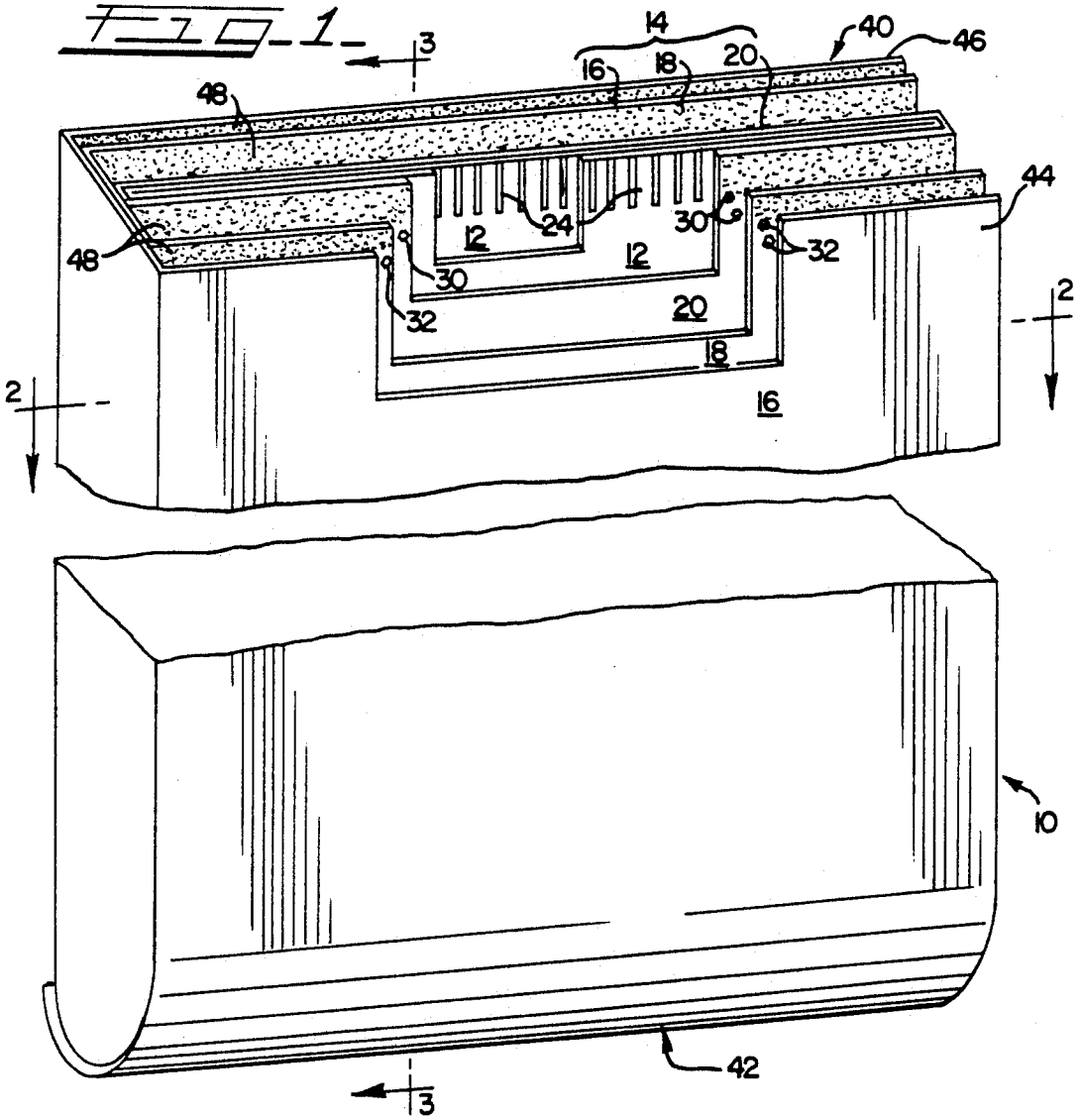

Throughout the Figures the reference numeral 10 is used to denote the bag made in conformance with the invention. In FIG. 1 the completed bag 10 in accordance with my invention will be seen to comprise an inner tubular ply 12 of heat sealable material, which may be polyethylene, or equivalent, within an outer tube 14 formed of a plurality of contiguous laterally offset plies 16, 18 and 20. The plies 16, 18, 20 are made of a non-heat sealable material, such as paper. With respect to the horizontal cross sectional view of the bag 10 shown in FIG. 2, it will be understood that the continuous plies 16, 18, 20 are laterally offset so that vertical overlapping edges are spaced laterally around the bag 10 wherein ply 16 is overlapped at edges 16′ 16″; ply 18 is overlapped at edges 18′ 18″ and ply 20 is overlapped at edges 20′ 20″. In the embodiment of FIGS. 1–13, the inner tubular ply 12 also is overlapped and laterally offset at its edges 12′ and 12″. The tubular formation is made in a blank form 22 illustrated in FIG. 4, which blank is produced on known stepped end tuber devices. The inner plastic ply 12 is heat sealed at the overlapping edges 12′, 12″ and the overlapping edges of the multiple non-heat sealable plies 16, 18, 20 are adhesively bonded thereat, such as by a hot melt adhesive applied in a known manner. During the formation of the blank 22 the inner ply 12 is circumferentially bonded at 24 at the top end thereof to the contiguous innermost paper ply 20. From the bond 24 downwardly the inner ply 12 remains detached from the outer tube 14 from 26 to 28 therealong. In the embodiment of FIGS. 1–13, the inner ply 12 is generally contiguous, or coextensive, with the inner paper ply 20, whereby to generally have the same lateral, or interior width edge-to-edge. The outer contiguous paper plies 16, 18, 20 are bonded, preferably by dots of adhesive, at both the top and bottom ends of the blank 22 and indicated at 30, 32 in FIG. 1.

Figure 2:
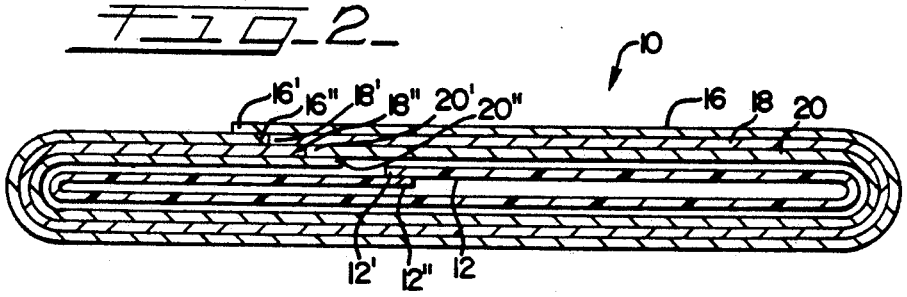
FIG. 2 is a horizontal cross section of the bag shown in FIG. 1 taken along the line 2—2 looking in the direction of the arrows.
Figure 5:
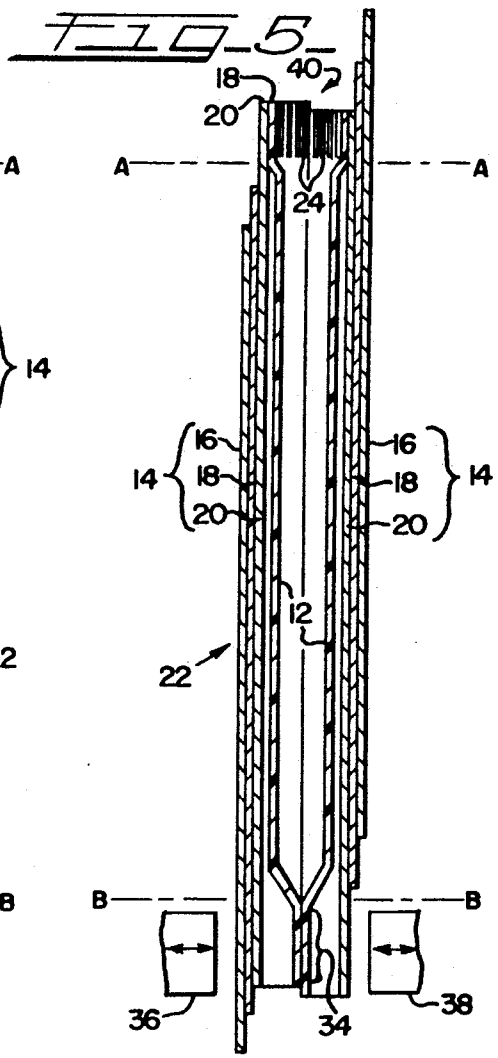
FIG. 5 shows the heat sealing at the lower end of the inner plastic ply of the blank as illustrated in FIG. 4 by the use of hot compression bars applied to the outer surfaces of the contiguous outer plies.
Figure 3:
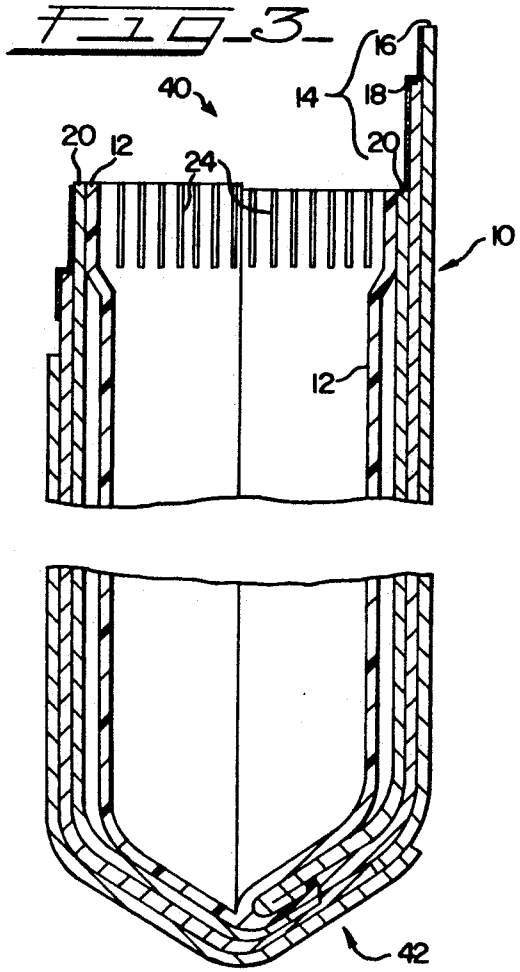
FIG. 3 is a vertical cross sectional view of the bag as shown in FIG. 1 taken along the line 3—3 looking in the direction of the arrows.

The blank 22 is subjected to the method steps of the present invention to result in the formation of the bag 10 shown in FIGS. 1–3 as will now be explained. Attention is directed to FIG. 5 wherein a first step is made by heat sealing the plastic ply 12 across a bottom closure zone 34 caused by applying heat bars 36, 38 at opposite sides of the outer contiguous non-heat sealable plies 16, 18, 20. As indicated by the arrows, the heat bars 36, 38 are urged toward each other to clamp against the blank 22 and thereby form the heat seal closure zone 34 whereupon they are moved in opposite directions so that the heated plastic cools to closure. The heat bars 36, 38 reach a temperature level sufficient to cause the inner ply 12 to become plastic and create a fusion bonding at the zone 34. The temperature and time required to effectively seal the plastic, such as polyethylene, will vary depending upon the thickness of the material used for the inner ply 12 and the total thickness of the outer tube 14.

Figure 4:
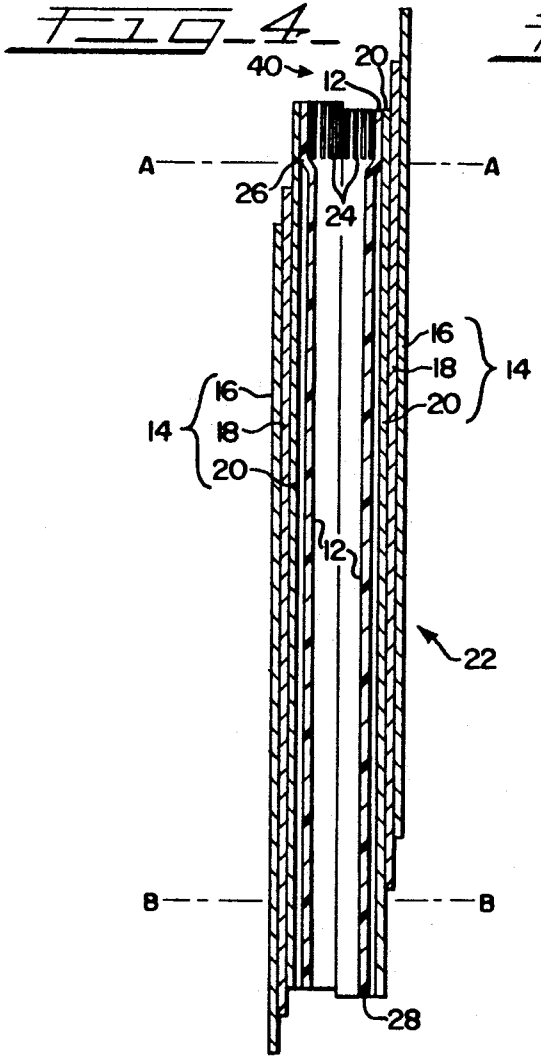
FIG. 4 is a vertical cross sectional view of a tubular bag blank which when subjected to the method steps of the present invention results in the bag as shown in FIG. 1.

Next, the bottom of the paper plies of the blank 22 are closed. A standard pinch bottom closure is effected by folding about fold line B—B shown in FIGS. 4 and 5 to create a closure at the lower end of the outer tube 14. The contiguous outer plies 16, 18, 20 are oppositely stepped at both ends of the blank 22, as shown in FIGS. 1, 3 and 4. Accordingly a pinched closure may be made at both ends of the bag 10. After making the closure at the bottom end, a folded overlapping arrangement is created as shown in FIG. 3. With reference to FIGS. 1, 3, 4 and 5 it will be seen that the bag is open at the top at 40, and is closed at the bottom end 42. At the open end 40, each ply is stepped up starting at an outermost front 44 of the ply 16 and proceeding to an outermost rear 46 of ply 16, with the exception of the inner plastic ply 12, which is flush cut evenly with the innermost non-heat sealable ply 20. At the closed end 42, shown in FIGS. 1, 3 and 6, the outer contiguous plies 16, 18, 20 are stepped in the exact reverse order as at the open end 40 with the plastic ply 12 f lush in the same way. Heat reactivatable hot melt adhesive 48, shown by the stippling in FIG. 1, is applied to at least portions of the exposed steps of both the end 40 and the end 42 of the tubular blank 22. In the case of the end 42, the pinch closure is made while the hot melt adhesive is still in the molten state and thus the closure is completed in a standard pinch bottom fashion. The inner plastic ply 12, which has been thermally sealed at zone 34, is loosely folded at the closed end 42, but not bonded, with the outer tube 14. It will therefore be apparent at the closed end 42 that the zone 34 is loosely and freely folded to lie between folded step portions of the outer contiguous plies 18 and 20.

Figure 7:
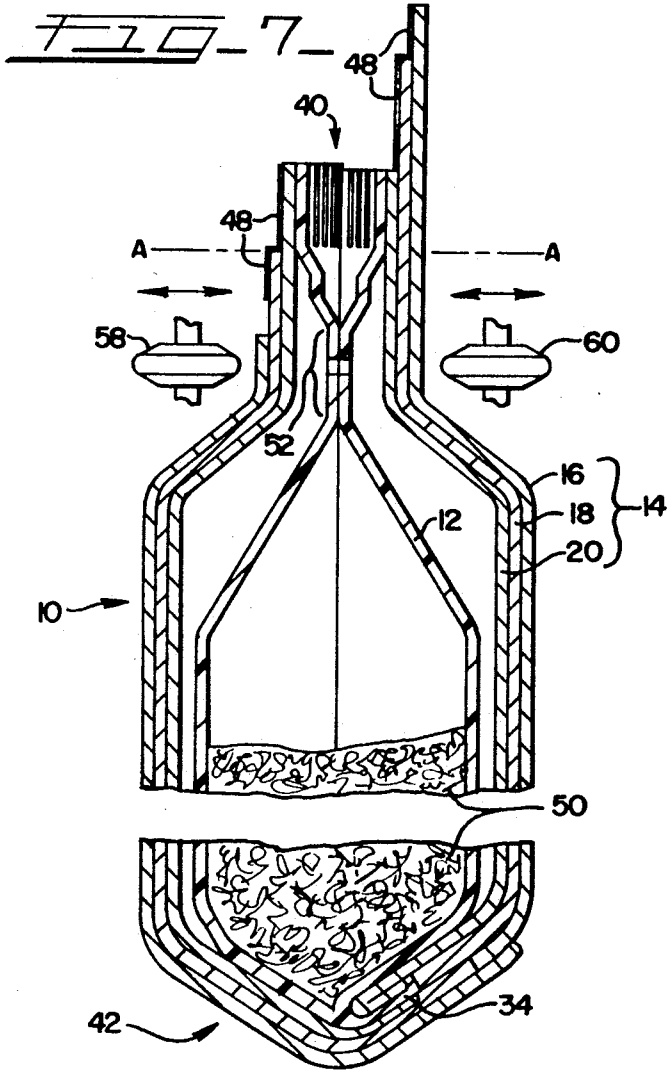
FIG. 7 is a vertical cross sectional view of the filled bag showing an optional severance of the inner plastic ply during the heat sealing at the top sealing zone thereof.
Figure 6:
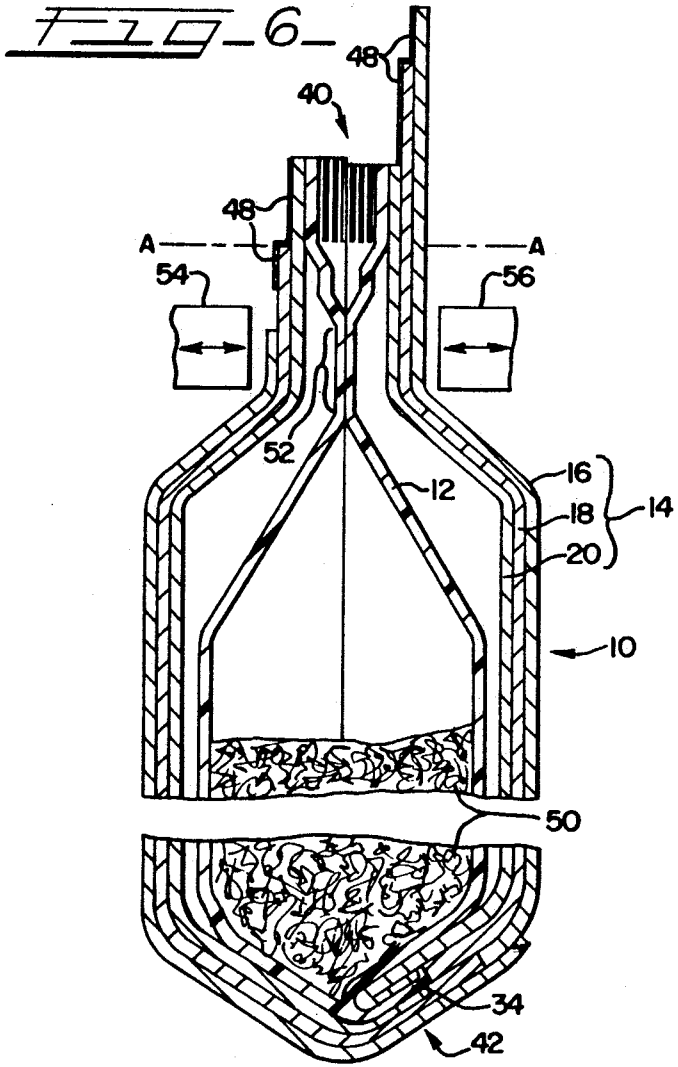
FIG. 6 is a vertical cross sectional view of the bag in accordance with the invention filled with a product and showing a heat sealing across a top zone of the inner plastic ply thereby forming a closed pouch.
Figure 8:
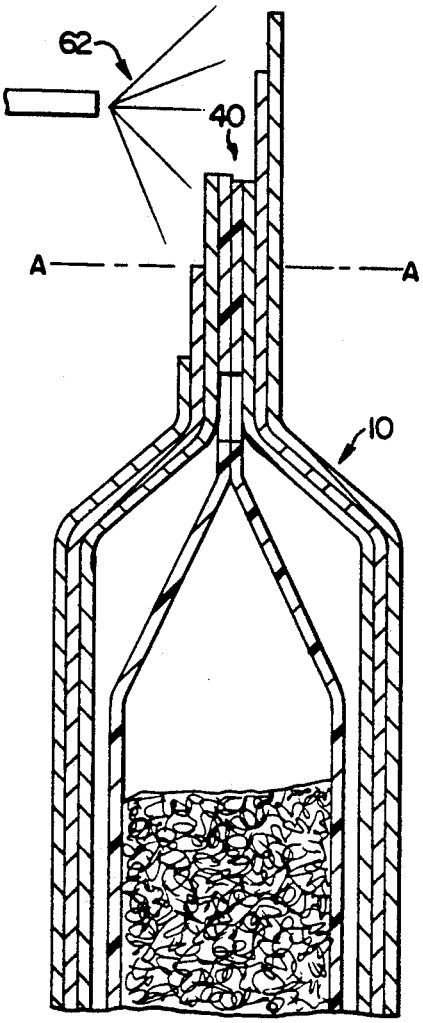
FIG. 8 is a vertical cross sectional view of the upper portion of the filled bag illustrating a heating device for liquefying a hot melt adhesive previously applied to the upper ends of the outer plies.

Closing the open end 40 is undertaken when the bag has been filled with a commodity or product 50 to be packaged generally in the same way as the closed end 42. The inner plastic ply 12 is fused to closure by the application of heat adjacent to, but below, the bond 24 across an upper region or zone generally referenced at 52 as shown in FIG. 6. The heat sealing is made by the application of hot compression bars 54, 56 to the outer sides of the outer tube 14 on opposite sides of the bag 10, similar to the action of the bars 36, 38 illustrated in FIG. 5. optionally, the inner ply 12 may be, but not need be, severed as shown in FIG. 7 by the application of beveled compression rollers 58, 60 on opposite sides of the heat sealed zone 52. The severance would depend upon the needs of the packer and also upon the closing equipment used by the packer of the commodity or product 50.

Figure 9:
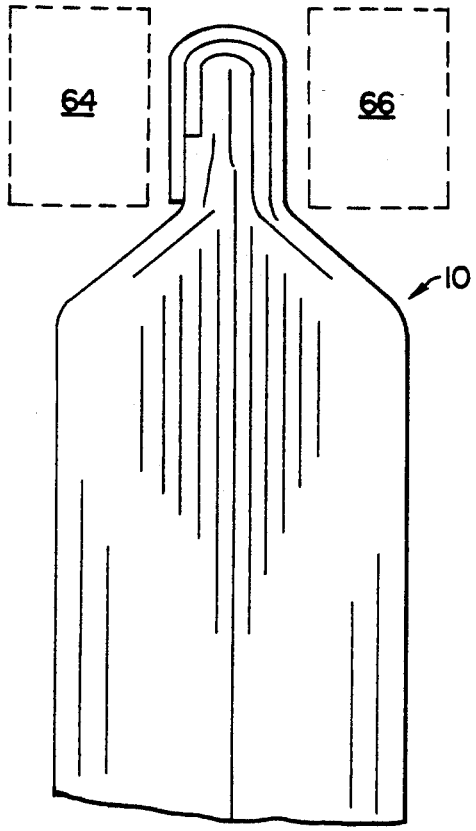
FIG. 9 is a side view of the upper portion of the filled bag with the outer plies folded over for passage between two pressure rollers to close the bag.
Figure 10:
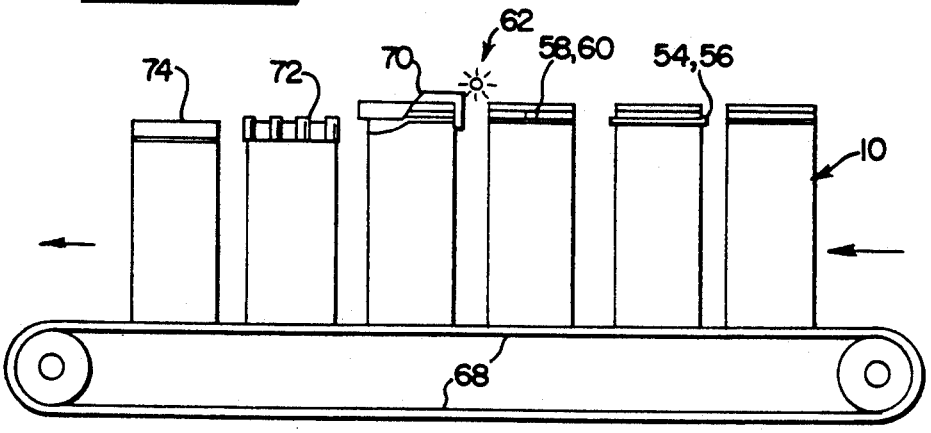
FIG. 10 is a schematic view of the sealing end closing of the top end of the bag as illustrated in FIGS. 6–9.

Following the heat sealing at 52, or at the severance thereat by means of beveled compression rollers 58, 60, the preapplied hot melt adhesive 48 at the open end 40 is heated, such as by a hot air blast 62, generally at the open end 40 and in the direction of the steps of the outer plies. When melted, the outer contiguous plies 14 are folded about fold line A—A shown in FIGS. 6 and 7 for sealing the opposed outer walls by means of passing the bag between pressure rollers 64, 66 illustrated in FIG. 9. The sequence for the steps explained in conjunction with FIGS. 6–9 for the closure of the open end 40 are further illustrated in the schematic illustration of FIG. 10. After the commodity or product 50 is filled to the desired amount within the inner plastic pouch 12, the filled bag 10 is placed on an endless conveyer belt 68 and carried thereon between the opposing hot compression bars 54, 56 to cause the inner ply 12 to be heat sealed at the zone 52 at the open bag end 40. The bag 10 is then carried between the optional beveled severing rollers 58, 60 and then passed through the hot air blast 62 to reactivate the hot melt adhesive 48. While the adhesive is in the melted state, the bag 10 is passed through a folding device 70, which may include the pressure rollers 64, 66, as shown in FIG. 9. To allow for adhesive set, the bag is then passed between a pair of pressure belts 72 toward the end of the conveyer belt 68 in fully packaged form generally denoted at 74.

Figure 13:
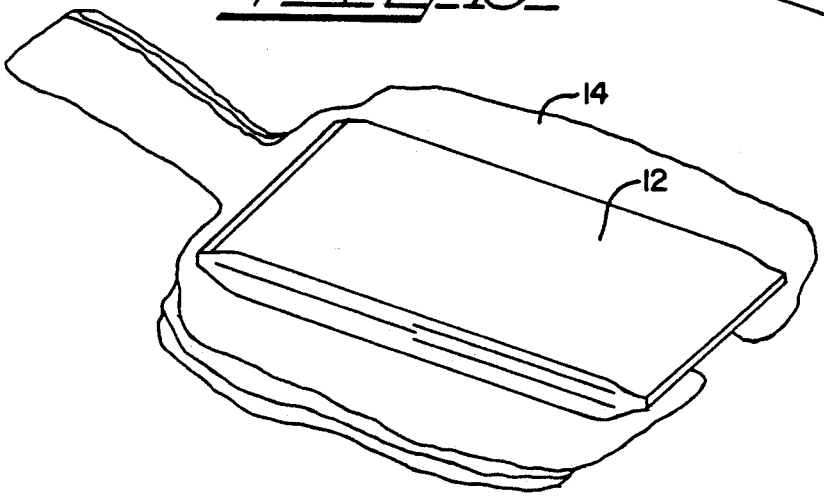
FIG. 13 is a perspective view of the bag of FIG. 12 showing the filled and sealed plastic inner pouch with the contiguous outer plies stripped away.

Thus, after the filled bag 10 illustrated in FIG. 9 is closed in the manner described for closing the open end 40, the packaged contents 50 will be completely sealed within the plastic ply 12, which provides an inner sealed pouch closed at both ends 40 and 42. At end 42, the heat sealed folded zone 34 may be wholly detached and removed from the outer plies 14 because the fold 34 is not adhered there, but is loosely restrained between the folded plies 16, 18. Hence, when the outer paper plies 16, 18, 20 are stripped away as shown in FIG. 13, the heat sealed plastic pouch 12 is left intact, sealed, clean and ready for use of the enclosed protected commodity or product 50. The loose non-adhesive restraint at the zone 34 allows for the inner plastic pouch 12 to be filled without putting undue pressure or forces on the heat sealed zone 34 and thus maintains its integrity, prevents bag collapse, and minimizes pinholing by remaining in the posture shown at FIGS. 6 and 7 during filling.

Figure 11:
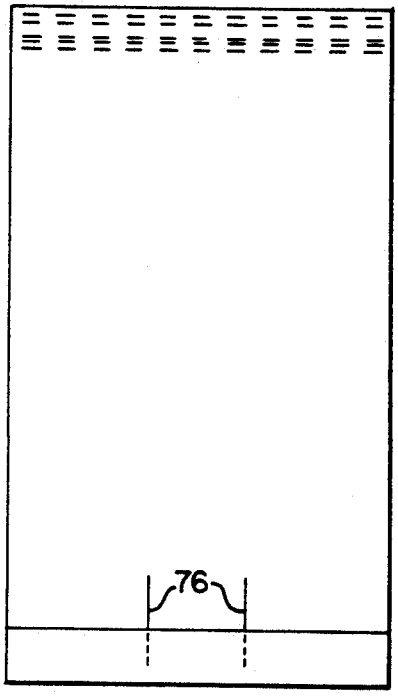
FIG. 11 is an elevational view of a filled and sealed bag having slits in the outer ply for the removal of the contiguous outer plies.
Figure 12:
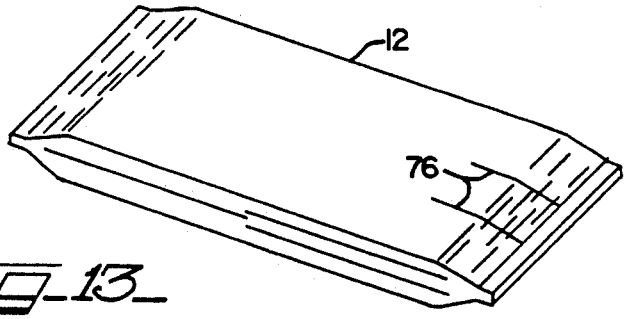
FIG. 12 is a perspective view of a filled and sealed bag as in FIG. 11.

As a means for enhancing the removal of the outer tube 14, a pair of slits 76, shown in FIG. 11, can be made in the outer non-heat sealable ply 20 at the closed end 42. These slits provide for a lifting and stripping of the paper plies by simply sliding one's hand between plies 20 and 18, at either, or both, of the slits 76. In doing so, one therefore will have gained entry and begun the process of stripping away and removing the outer paper plies, as shown in FIGS. 12 and 13.

As an example, the type of commodities or products that can be packaged in the bag 10 consist of 25, 50 or 100 pound quantities of powdered food items, such as dry milk, eggs, flour, soya meal, or cereals. The bag 10 may also be used for packaging chemicals and pharmaceuticals due to the effective heat sealed closure of the inner plastic pouch and the assurance that the bottom seal integrity has been maintained during filling.

Accordingly, a bag 10 formed in accordance with the embodiment of FIGS. 1–13 for the invention provides for the bonding together of contiguous laterally offset paper plies, and binding the paper plies, or equivalent non-heat sealable material, together at opposite ends without attachment between the ends. Then, an inner plastic heat sealable ply is bonded at one end only to the outer contiguous non-heat sealable plies. The tubular blank, as at 22 in FIGS. 4 and 5, is formed by adhering each ply to itself along the laterally offset edges at 12', 12''; 16', 16''; 18', 18''; and, 20', 20'' noted above. The heat sealable ply 12 resides within the non-heat sealable outer tube 14 and the opposed walls of the inner ply are then heat sealed to closure in the zone 34. Next the blank 22 is subjected to a standard pinch bottom closing procedure freely folding the zone or flap 34 at the folded closure end 42 between the adhered plies 16, 18, 20 in a loose non-adhesive manner. These steps may be achieved in conjunction with the utilization of a device as taught in U.S. Pat. No. 2,897,730 to Browning.

Figure 14:
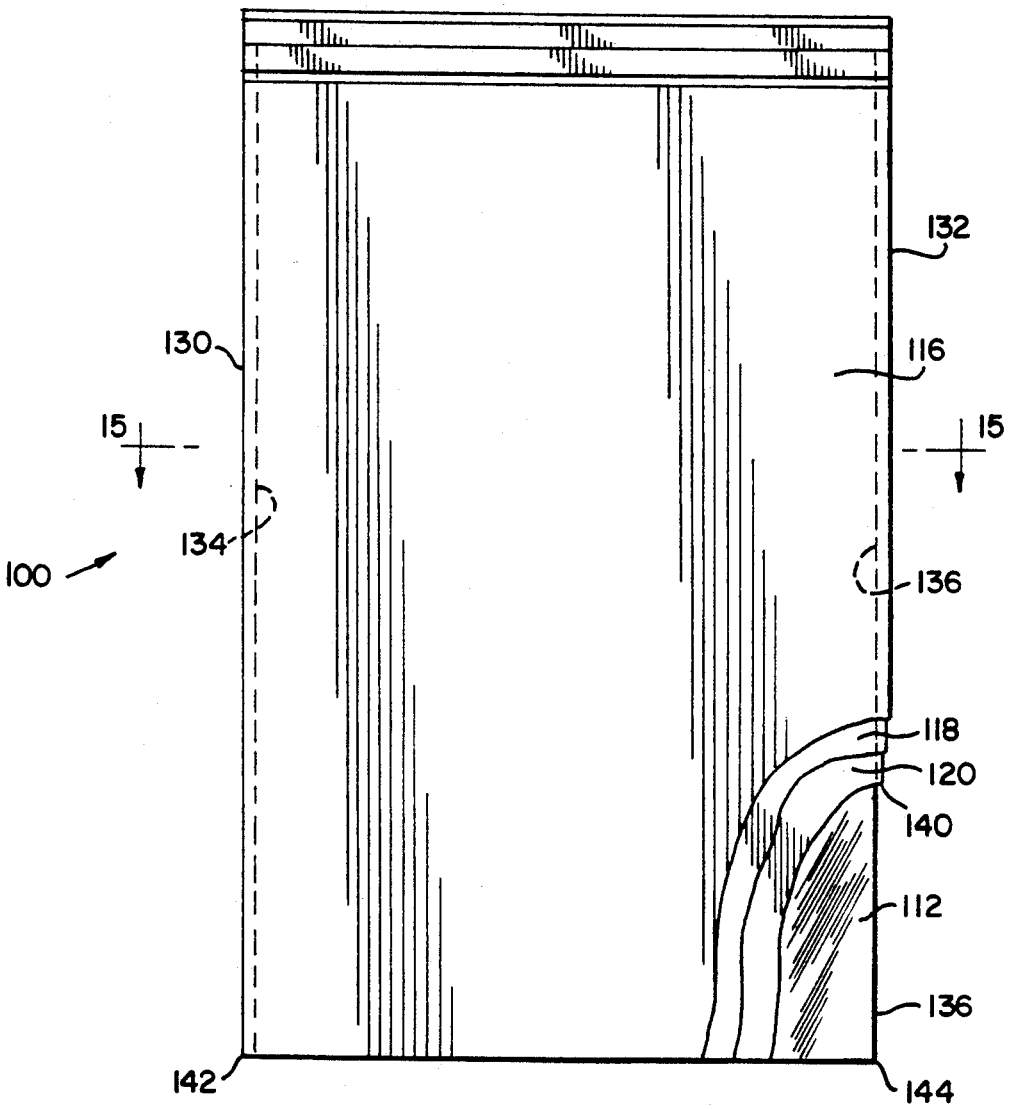
FIG. 14 is a front elevational view, partially broken away, of an alternate embodiment of the invention showing the tubular bag blank including a modified inner tubular plastic ply; and, FIG. 15 is a horizontal cross-section of the bag shown in FIG. 14 taken along the line 15—15 looking in the direction of the arrows.
Figure 15:
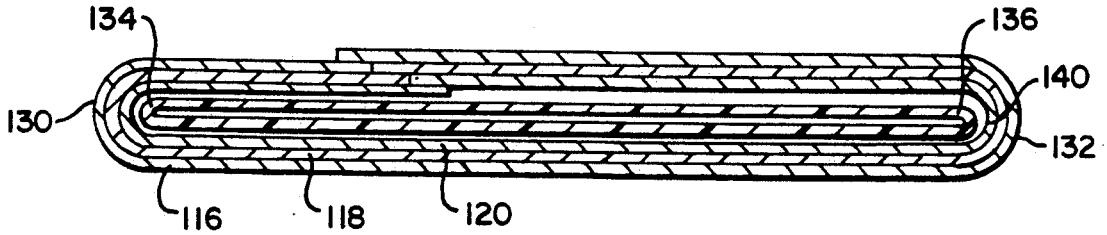

Turning now to FIGS. 14 and 15, it will be seen that an alternate embodiment for the present invention is disclosed. In this embodiment, the inner plastic ply is a seamless tube being non-contiguous with the paper plies, particularly the adjacent inner-most paper ply 120.

The embodiment for the alternate bag is generally denoted by reference numeral 100. It has been learned that for certain applications, it is important to further avoid pinholing or rupturing of the tubular liner along the lateral vertical edges thereof. In the embodiment shown in FIGS. 1–13, when the bag blank 22 is formed, the polyethylene inner ply 12 is formed tightly against the adjacent paper ply 20 and particularly along the lateral vertical edges. This forms a pair of parallel zones that create natural pinch points at the bag bottom when the bottom is folded over in the bag bottom closing process as shown in FIGS. 4, 5, 6. As a result, when the bag top is open and the inner filled plastic pouch 20 is dumped out of the paper bag liners, the plastic pouch resists flowing freely at the outermost lateral edges of the bag bottom, and also potentially along the vertical edges extending upwardly therefrom, creating a stretching of the plastic liner 12 at these places. It is not only difficult to get the plastic pouch to release, but the stretching of the plastic pouch, or ply 12, generates weak points, which could result in rupturing. Another disadvantage of the longitudinally seamed construction for the tubular ply 12 is that the adhesive bonding at the overlap of offset edges 12' 12'' inherently establishes potential failure points. While the configuration of FIGS. 1–13 is functional and overcomes many problems in previous bags, the longitudinal seam could also fail when the filled pouch is dumped out of the paper bag and impacts a landing surface.

As a result, the alternate embodiment of FIGS. 14 and 15 is a further improvement to the bag described with respect to FIGS. 1–13 by the provision of a seamless tubing 112 that solves the two major problems discussed in the foregoing paragraph, as well as obtaining further advantages. In reference to FIG. 14, there are likewise provided three paper plies laterally offset as in the embodiment of FIGS. 1–13, which comprise an outer paper ply 116, an intermediate paper ply 118 and an inner-most paper ply 120 inwardly arranged around the plastic seamless tubular liner 112. It will be observed in FIGS. 14 and 15 that the inner plastic tube 112 is not extensive with the paper plies as is plastic ply 12, and particularly it is laterally spaced from the inner-most, adjacent, ply 120. The criteria for the non-extensive tubular ply 112 in this form of the invention is preferably that the ply 112 have a nominal width ½ inch+/±¼ inch narrower then the nominal finished bag width, generally defined by opposite edges 130, 132. Inner vertical lateral edges of the plastic tube 112 are generally referenced at 134, 136. The non-extensive arrangement allows each plastic tube 112 edges 134, 136 to be spaced inwardly, preferably ¼ inch from the respective lateral edge of the inner-most paper ply 120. Focusing on the lower right-hand corner of FIG. 14, bag 100 is illustrated to be cut away to disclose the edge 136 spaced inwardly from the lateral vertical edge 140 of the inner ply 120. This also allows a more readily detachable arrangement when the bag is filled, and is achieved in manufacturing when the bag bottom is folded over during the closing process, so that the plastic ply 120 is not pinched tight at the bag edge corners 142, 144 when later filled with product, such as dry milk powder. Avoidance of the corner pinching permits the tubular ply 112 to be easily dumped from the outer paper bags 116–120 without distortion or rupture at the left and right hand lower corners 142, 144. Moreover, the tubular ply 112 does not require a glued or heat-sealed longitudinal seam, as at the overlap 12' 12'' of ply 12 in the first embodiment of the invention, and therefore eliminates the above-noted possibility of adhesive bond/seam failure therealong.

An additional advantage of the narrower or non-extensive structure for the tube 112 is that the natural elasticity of the plastic material, such as the preferred polyethylene extrusion, cooperates like a shock absorber when the bag is being filled relative to the outer paper plies 116–120 of the bag, which are naturally more rigid and less stretchable. The beneficial result is that it is less likely for a bag of this construction to rupture along bag edges 134, 136 relative to 130, 132 than coextensive type constructions of the prior art.

The pinch bottom closure at the bottom of the bag 100 may be made in the same manner as explained in regard to the embodiment for blank 22 shown in FIGS. 4, 5 and 6, wherein a standard pinch bottom closure provides a freely folding arrangement of the plastic tube in the same manner to create a loose non-adhesive detachable relationship.

The bag 100 comprises three or more contiguous outer paper plies of multiwall grade paper with a seamless inner plastic tube, heat-sealable pouch 112 that is significantly narrower than the outer paper plies. When the bag 100 is filled and sealed, it will allow the outer plies of paper 116–120 to be opened at the bag top end with the inner plastic pouch remaining sealed for easy removability from the outer paper plies without weakening, by distortion or rupture, of the plastic pouch 112. The prior art deficient techniques for the manufacturer of plastic liners required the inner plastic pouch in flat bags to be contiguous with the outer paper plies or within the edge folds for gussetted bags. In manufacturing that way, those bags would not function to allow the inner plastic pouch to remain assuredly sealed and easily removable from the outer paper plies without weakening by the said distortion or rupture of the plastic pouches provided. It should be noted that even small percentage failure rates in the food packaging industry can not be tolerated one bag failure per 1000 could result in the rejection of a whole shipment of packages. The failures of these prior art bags occurred because the inner plastic pouch would be folded tightly in the opposed corners, as in the region of 142, 144 of the present invention, while the bag bottom was formed and/or closed. This resulted in a tight-folded corner and a pinching of the plastic pouch between the paper plies at the closure fold of the bag bottom corners in the location of great stress and pressure during the filling of the bag. The resistance to releasing the plastic pouch from the corners of the outer paper bag plies at these pinch point causes stretching or distortion of the plastic pouch there. An elastic pouch made that way is susceptible to rupture mainly at one or both of the bottom corners and secondarily at places upwardly therefrom extending possibly to the top of the bag.

The embodiment as shown in FIGS. 14 and 15 eliminates the distortion by positioning the outer edges of the plastic pouch 112 significantly inwardly from the contiguous outer paper plies thereby eliminating the tight folded corners as illustrated by the cross-sectional view of FIG. 15. FIG. 15 also makes clear the seamless configuration of the tube 112 wherein there are no lateral offsets stepped zones of adhesive seaming or hot melt bonding, such as between 12' and 12'' shown in the first embodiment of the invention.

The bag 100 in accordance with FIGS. 14 and 15 provides a plastic tubular non-extensive tubular liner or pouch 112 that is easily removable and free of distortion or rupture during bag filling and subsequent dumping of the filled plastic liner from the outer paper plies by the end user.

Accordingly, the invention has been described in conjunction with a preferred embodiment and with means for conducting the method steps. However, the specification and description are provided in connection with explaining only one embodiment of the invention and it is envisioned that a wide scope of equivalents fall within the claims appended hereto.

What is claimed is:

1. A flat non-gusseted tubular wall bag for the receipt therein of a product and being open at one end and closed at an opposite end, the bag comprising:

a plurality of contiguous outer plies of non-heat sealable material;

a seamless inner ply of heat sealable plastic material adapted to be heat sealed to closure;

said inner ply bonded at only a single line of adhesive to said outer ply generally at said bag open end;

said bag closed end comprising a pinch-closed end wherein only the non-heat sealable outer plies being bonded together thereat;

said seamless inner ply being heat sealed to closure across a zone thereof at the closed end and said heat seal closure being loosely and freely folded to be non-adhesively restrained between said outer plies at said pinch closed end;

said inner plastic ply being non-extensive with said outer plies, said outer plies having opposite lateral edges and said inner ply having opposite lateral edges spaced inwardly of said outer ply lateral edges, said outer plies terminating in lower left hand and right hand corners at said pinch bottom closure, said lateral edges of said inner ply being spaced from said corners and being loosely restrained at said pinch closure between said corners; and, said inner plastic ply extending from said pinch closed end to the said open end of the bag and being spaced inwardly from said lateral edges of said outer paper plies from the bag bottom to top.

2. A multiwall bag of flat non-gusseted tubular form being opened at one end and closed at an opposite end, said bag comprising:

a plurality of contiguous outer paper plies;

a seamless plastic flat liner capable of being heat sealed to closure and arranged within said contiguous outer paper plies;

said seamless plastic flat liner being bonded to the outer plies only at the open end of the bag, and only the paper plies being bonded together at said opposite closed end;

said paper plies having opposite left and right marginal edges and one of said paper plies being an inner-most paper ply, said seamless plastic flat liner having opposite lateral edges being spaced inwardly of said lateral edges of the inner-most paper ply;

said seamless plastic flat liner being heat sealed to closure at a zone thereof generally at the closed end of the bag and said paper plies being pinch-closed at said bag closed end, said heat sealed closure of the flat liner being freely detachably folded with the pinch closed end of the paper plies, said lateral left and right edges of said paper plies forming left and right corners of the pinch closure, said seamless plastic flat liner having lower left and right corners spaced inwardly away from the corners of said paper plies; and, said seamless plastic flat liner capable of being heat sealed to closure at the bag, open end by the application of heat and pressure to the outer-most paper ply, whereby said seamless plastic flat liner forms an inner plastic pouch having a width significantly less than the inner-most paper ply.

3. The multiwall bag as claimed in claim 2 wherein said bag has at least three paper plies.

4. The multiwall bag of claim 2 wherein said lateral edges of the seamless plastic flat liner are spaced inwardly of the lateral edges of said inner-most paper ply in the range of about ⅛ to ⅜ inch from each edge thereof.

5. The multiwall bag as claimed in claim 2 wherein said seamless plastic flat liner is extruded polyethylene.

6. The multiwall bag as claimed in claim 2 wherein said inner plastic ply is heat sealed and severed at the bag open end below said bonding.

7. A non-gusseted tubular package having a sealed inner plastic pouch within a closed outer paper bag comprising:

a plurality of contiguous outer paper plies;

an inner pouch having a heat sealed upper end, a heat sealed lower end and being a seamless tube therebetween;

the paper plies being bonded together at a pinch closed end and restraining therein the lower heat sealed end of the seamless plastic pouch in a freely detachable folded arrangement therebetween;

said paper plies being bonded closed at an opposite end thereof generally above the upper heat sealed end of said plastic pouch;

said seamless plastic pouch having opposite lateral edges being spaced from lateral edges of the outer paper plies;

said plastic pouch and outer paper plies having no adhesive bonding therebetween at or below said upper heat sealed end of said plastic pouch; and, a product sealingly contained within said plastic pouch.

8. The tubular package as claimed in claim 7 wherein said upper heat sealed end of said plastic pouch is severed thereacross and fully separable from the outer paper plies.

9. The tubular package as claimed in claim 7 wherein said package has lower left and right hand corners of said paper plies pinch closure and wherein said lateral offset edges of said plastic pouch are spaced inwardly from the corners whereby said freely detachably folded portion of the plastic pouch is spaced inwardly of the lower corners.

10. The tubular package as claimed in claim 7 wherein said lateral edges of the plastic pouch are spaced by at least about ⅛ inch to ⅜ inch from lateral edges of the inner-most paper ply of the paper plies.

11. The tubular package as claimed in claim 7 wherein said plurality of contiguous outer paper plies comprise three paper plies.

12. The tubular package as claimed in claim 7 wherein said seamless plastic pouch comprises a seamless extruded polyethylene tube.

13. A flat non-gusseted tubular pinch bottom multiwall bag comprising, at least three contiguous outer plies of a non-heat sealable paper and an extruded seamless inner plastic pouch substantially narrower than said outer plies, said seamless inner plastic pouch having a heat sealed bottom end freely foldably restrained at a pinch bottom closure of said outer plies at one bag end and being open at an opposite bag end for receipt of product therein, said seamless inner plastic pouch having lower left and right corners spaced inwardly from lower left and right corners of the outer paper plies at said pinch bottom closure thereof, whereby the corners of said inner plastic pouch are not folded with the corners of said paper plies and the plastic pouch extends therefrom to said open end to be spaced inwardly of an inner-most of said three on more contiguous outer plies.

14. The flat tubular pinch bottom multiwall bag as in claim 13 wherein only the open upper end of said seamless inner plastic pouch is adhesively bonded generally thereat to said outer paper plies and being non-adhesively and freely detachable therebelow.

15. The flat tubular pinch bottom multiwall bag as in claim 13 wherein said extruded seamless inner plastic pouch is narrower than said inner-most of said outer plies by at least about ⅛ inch to ⅜ inch from either side thereof.

* * * * *

UNITED STATES PATENT AND TRADEMARK OFFICE

CERTIFICATE OF CORRECTION

PATENT NO. : 5,281,027
DATED : January 25, 1994
INVENTOR(S) : Ronald G. Thrall

It is certified that error appears in the above-indentified patent and that said Letters Patent is hereby corrected as shown below:

Title page, item [73], Assignee: delete Bimis Company, Inc., Minneapolis, Mich." and replace therefor -- Bemis Company, Inc., Minneapolis, Minn. --.

Signed and Sealed this

Nineteenth Day of July, 1994

*Attest:*

*Attesting Officer*

BRUCE LEHMAN

*Commissioner of Patents and Trademarks*